United States Patent [19]

DeFranco et al.

[11] Patent Number: 4,788,798

[45] Date of Patent: Dec. 6, 1988

[54] ADHESIVE SYSTEM FOR MAINTAINING FLEXIBLE WORKPIECE TO A RIGID SUBSTRATE

[75] Inventors: Paul J. DeFranco, Twinsburg; Alan G. King, Macedonia; Anthony S. Scheibelhoffer, Norton, all of Ohio

[73] Assignee: Ferro Corporation, Cleveland, Ohio

[21] Appl. No.: 47,749

[22] Filed: May 7, 1987

Related U.S. Application Data

[63] Continuation-in-part of Ser. No. 843,469, Mar. 24, 1986, abandoned.

[51] Int. Cl.[4] ..... B24D 11/00; B32B 7/02; C09J 7/02

[52] U.S. Cl. ..... 51/406; 428/42; 428/212; 428/355; 51/395

[58] Field of Search ..... 51/406, 407, 394, 395, 51/DIG. 34; 428/40, 41, 42, 343, 352, 355, 212, 214, 537

[56] References Cited

U.S. PATENT DOCUMENTS 4,558,542 12/1985 Marton ..... 51/401

*Primary Examiner*—Frederick R. Schmidt
*Assistant Examiner*—M. Rachuba
*Attorney, Agent, or Firm*—Shlesinger Fitzsimmons Shlesinger

[57] ABSTRACT

Lens grinding or polishing pads are provided, characterized by a bonding system which permits them to be quickly and easily contact-adhered to the surface of a lens finishing tool, but which pads at the same time display strong resistance to lateral displacement during use. These pads can also be readily and easily stripped from the finishing tool without deformation or damage to them.

9 Claims, 1 Drawing Sheet

ADHESIVE SYSTEM FOR MAINTAINING FLEXIBLE WORKPIECE TO A RIGID SUBSTRATE

RELATED APPLICATIONS

This application is a continuation-in-part of our pending U.S. application Ser. No. 06/843,469, filed Mar. 24, 1986, now abandoned, for Two Component Adhesive System For Maintaining Flexible Workpiece To A Rigid Substrate.

FIELD OF THE INVENTION

This invention relates to an adhesive system for temporarily bonding a grinding or polishing pad for lens blanks to the curved surface of a lens grinding tool or lap. More specifically, it deals with a bonding system which permits a lens grinding or polishing pad to be readily and easily stripped from the tool surface, either for slight repositioning or later reuse, but which also provides exceedingly high shear or blocking strength, thus imparting to the pad an extremely high degree of resistance to lateral displacement during the grinding or polishing operation.

BACKGROUND OF THE INVENTION

Pads for grinding or polishing lens blanks have been known for quite some time. For example, U.S. Pat. No. 3,959,935 discloses a lens blank grinding pad comprising a pliable sheet of water-proof material (e.g., paper or fabric) with an adhesive coating on one side thereof for adhering said pad to the surface of a lens grinding or polishing lap or tool. This patent then suggests dispersing an abrasive substance, such as silicon carbide, on the surface of the pad, so as to permit a smooth fit over the curved working surface of the underlying tool.

While this prior U.S. patent contemplates that a prepolishing pad is first fitted to the working surface of the tool by suitable adhesion means, following which the grinding pad is then contact-adhered to the surface of the prepolishing pad, this disclosure does not contemplate distortion-free removal for later re-use, or for ease of repositioning adjustment prior to commencement of the grinding or polishing operation. As U.S. Pat. No. 3,959,935 states, at the top of Column 4, "Once used, the abrasive-impregnated pad is removed and another pad is used for grinding another lens blank."

For further background relating to this particular invention, see U.S. Pat. No. 4,086,068 issued Apr. 25, 1978, which discloses a configured lens grinding and polishing lap-cover. This patent recognized the same problems solved by the instant invention, but pursued an entirely different approach to the solution.

That is, this latter patent expressly noted that prior lap-covers could not be cleanly stripped in one piece from the lap surface, by merely detaching one portion of the lap-cover, then stripping off the entire cover. The '068 patent tackling the problem from the standpoint of utilizing something of a centipede-shaped pad whereby the side, appendage portions (legs) thereof did not tend to tear away as the leading end (or head) was stripped back towards the tail, or terminal end.

However, the pad or lap-cover configuration taught and claimed by this particular patent is severely restrictive in that it provides literally no freedom from the standpoint of pad design.

To be noted also, the pressure-sensitive adhesive suggested by the '068 patent for adhering its lap-cover directly to the working surface of the tool was 3M "Scotch" 442DCY double-coated tape. As is well known in the art, this is an extremely tacky, highly-adhesive material, which characteristic is readily confirmed by the '068 disclosure. That is, in order to cope with this type of difficulty-strippable adhesive, the '068 disclosure suggested that it was essential to redesign the pad itself. Opposed to the teachings of this patent, the instant invention approaches the problem by materially altering the characteristics of the adhesion system, thereby permitting unrestricted freedom of pad design.

DETAILED DESCRIPTION OF THE PREFERRED EMBODIMENTS

Figure 1:
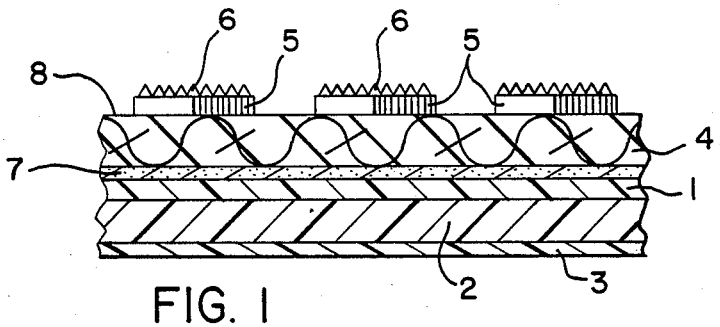
FIGS. 1, 2 and 3 are the various stages of the laminated pad, with FIG. 1 showing the final product.

The first step contemplated by this invention to achieve its objective, is to provide a permanent or semi-permanent, smooth, glossy surface on the grinding or polishing tool having a certain wetting characteristic, as will hereinafter be defined. This can be done by affixing directly to the surface of the grinding or polishing tool, which is usually a metal surface, an organic intermediate layer or film. Exemplary of a film which is suitable for this purpose is "Mylar", Dupont's trademark for its commercial family of polyester films. As a matter of fact, just about any smooth, relatively glossy intermediate cover, such as foil, or even water-proof paper, could be utilized, although polyester film is preferred.

At any rate, a thin, intermediate, smooth, relatively glossy surface film, normally exhibiting virtually no surface adhesive characterists, semi-permanently, and firmly and smoothly covering the tool surface, is the first step in accomplishing the two-component adhesive system of the instant invention.

Any number of methods, or adhesives, may be used to semi-permanently bond the polyester film, or intermediate layer, to the curved, metal surface of the lap. By a little trial and error, a suitably shaped oval or circular piece of polyester film may be snipped in such a way that, when adhered to the generally hemispherical, truncated surface of the lap, it will neatly conform with no overlap of itself. In this regard, it might be possible to highly polish the metal surface of the lap to a mirror finish, to thereby achieve a smooth and glossy surface similar to that of the polyester film intermediate.

It is to this smooth and glossy surface that a grinding or polishing member which is susceptible to distortion and tearing, will be strippably adhered. It is usually the shape and/or the material used in the grinding or polishing member which leads to its being susceptible to distortion and/or tearing. The material should be flexible to be able to conform to the shape of the grinding or polishing tool. The member may also have a shape which facilitates conformance, such as a petal shape or scallop shape, but it could also be normal shapes, such as circles, ovals, etc. Also, the member is usually produced by die cutting a larger piece. The fact that the member is flexible, cuttable, and may have a shape which can be subjected to uneven pulling forces leads to the members being susceptible to distortion and tearing.

Next, a suitable polymeric adhesive composition is prepared and applied to the reverse surface of the lap-cover, polishing or grinding pad, as hereinafter described, said composition having characteristics such that the thus coated pad will lightly adhere to the surface of the tool, but which, when in firm contact with said film, demonstrates such shear strength, that it is nearly impossible to laterally displace the pad while so adhered, particularly under the pressures involved during a grinding or polishing operation.

We have consequently discovered that there are a number of critical, quantitative criteria which must be met by the adhesive system of this invention, namely, a workable range of peel, tack and shear values, as well as the relationship between the surface energy of the substrate, i.e., the surface on the grinding or polishing tool, and the surface tension of the adhesive. That is, if peel strength is too high, deformation and/or destruction of the pad upon stripping is likely to result; if it is too low, accidental and premature dislodgement, prior to, or during, grinding or polishing, can result with the attendant loss of time required for repositioning, etc.

By the same token, while there is no upper limit to desirable shear strength, vis-a-vis peel strength, a minimum shear value, obviously, is absolutely essential to prevent movement of the lap-cover or pad on the tool, during or preceding a grinding or polishing operation.

A third, critical characteristic of this adhesive system is tack. By that is meant the stickiness, or relative ease with which the adhesive component of this system adheres to the glossy, polyester substrate.

That is, it is conceivable that the adhesive component, in combination with the polyester intermediate layer, could demonstrate perfect peel and shear strength. However, it might also require literally hundreds of pounds of pressure to cause it to initially adhere to the polyester intermediate layer because of low tack. Thus, there must be a minimum tack value, as hereinafter defined, to enable the pad to be adhered to the intermediate polyester layer under only moderate hand pressure. There would appear to be no upper limit to tack, except to the extent it might interfere with the required peel strength values.

The relationship between the substrate and the adhesive is a value which extends beyond the tack of the adhesive, and which permits the grinding and polishing means to be releasably adhered. The surface energy of the substrate which relates to its ability to be wetted should be between about 40 and 200 dynes per centimeter. The substrate means the surface of the tool, whether polished to a roughness of less than or equal to 0.1 micron, or covered by an intermediate layer having a surface roughness of less than or equal to 0.1 micron. The surface tension of the adhesive will be between about 45 and 100 dynes per centimeter, but the relationship is such that the surface energy of the substrate surface is more than or equal to the surface tension of the adhesive.

Following are the preferred, specific quantitative criteria for peel strength, shear strength, and tack, along with the method for determining same. The two former values are determined with respect to the polyester intermediate, or its equivalent.

Adhesive Strength Values, Preferred Ranges

1. Peel Strength Range:

10–250 grams force/inch width

Above 250 grams, the adhesive is too sticky, therefore too difficult to remove once bonded. Below 10 grams, the adhesive is not strong enough to resist peeling forces caused by curvature mismatch between the lap and pad, or by initial positioning. Measured according to American Society of Testing and Materials D1876 Standard Test Method for Peel Resistance of Adhesives.

2. Shear Strength Range:

0.7–2.00 kg. force/cm$^2$ bonded area

Above 2.00 to 2.5 kg./cm$^2$ force, the adhesive may tend to become rigid, and does not absorb energy very well before failing. This is necessary to handle shock loads. However, as stated above, unless high shear strength contributes to some undesirable characteristic, it has no operational upper limit. Below 0.7 kg./cm$^2$, the adhesive is not strong enough to resist shearing action. The adherends tend to roll up into crumpled structures. Measured according to ASTM D3165 Standard Test Method for Tap Shear Strength of Adhesives with Non-Metallic Substrates.

3. Tack Range:

15–30 cm travel

This test measures the distance a steel ball rolls across a surface coated with the adhesive before coming to rest. The numerical values are in inverse proportion to adhesive tackiness; i.e., a pressure-sensitive adhesive with 4 cm travel by this test is extremely tacky. Measured by ASTM D3121 Standard Test Method for Rolling Ball Tack.

Set forth below are representative working examples of this invention having values within the ranges set forth above.

EXAMPLE 1

Granular Geon 138, an ethylene polyvinyl chloride copolymer available from B.F. Goodrich, was thoroughly mixed with a liquid plasticizer, "Santicizer" 160, from Monsanto, which is a butyl benzyl phthalate, and stirred until the copolymer was dissolved and thoroughly dispersed in the plasticizer. The weight ratio of copolymer to plasticizer was 1:1.

The above solution was then cast as a thin film, approximately 5 mils thick, on a support film such as polyester, cellophane, or aluminum foil; the foregoing exemplary of but only a few of support film materials useful in the practice of this invention.

The foregoing combination was then heat cured at approximately 165° C. for approximately 7 to 8 minutes, until the plasticized PVC resin had polymerized to a rubbery, elastomeric layer, tightly adhered to the underlying sheet on which it had been cast. Good adherence with the PVC resin, otherwise relative inertness, and flexibility are the essential requirements for the support film. Following cooling, the exposed surface of the cured elastomeric layer was covered with a release film such as polyethylene, silicone coated paper, or parchment, which are only exemplary of any thin, protective layer which could be pressed into service as a readily peelable, release film.

Figure 2:
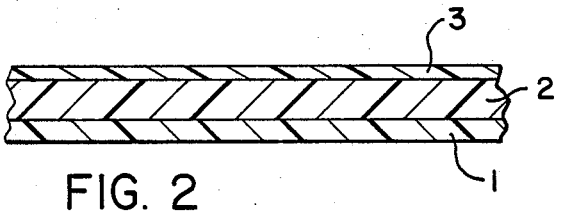

Referring to the attached drawings, FIG. 2 depicts the laminate thus formed, wherein the base sheet on which the dissolved vinyl copolymer was cast is depicted by the reference numeral 1; the cured, elastomeric PVC copolymer is designated as 2, and the release film peelably adhered to the exposed surface of the elastomeric layer 2, is designated as 3.

Although any well-known, conventional method may be utilized to form the abrasive, grinding or polishing pad, one embodiment was fashioned using the following procedure.

A rubber-impregnated cloth manufactured by Ferro Corporation, assignee herein, and designated as KZ-726, was utilized as the basic structure for the polishing or grinding pad. Obviously however, the basic pad material is not critical, is a matter of choice, and may be selected from a wide variety of flexible, sheet-like materials available on the market for this purpose.

A metallic foil, also readily available commercially, with polishing or grinding media adhered to one face thereof, was selected. For this example, a brass foil having diamond particles adhered to one surface thereof via nickel as the adhesive, was obtained from the Amplex Corporation of Bloomfield, Conn. This abrasive foil was then cut into relatively small hexagonal pieces measuring approximately 95 mils across opposed flats. Preferably before subdividing the abrasive foil, its reverse surface was coated with any suitable, hot-melt adhesive such as readily obtainable from 3M, identified as its Jet-Melt 3796.

Utilizing any appropriate means, the hexagonal pieces of grinding or polishing foil were then adhered to one surface of the rubber-impregnated cloth aforesaid, utilizing a combination of heat and pressure. As well known in this art, patches of abrasive particles are frequently employed in this manner, spaced apart from each other, thereby creating channels to facilitate the flow of water, or other liquid media, for carrying abraded particles away from the work surface.

The reverse of the rubber-impregnated cloth was then coated with a polyurethane adhesive, such as 3M's Scotch-Grip 2218.

Figure 3:
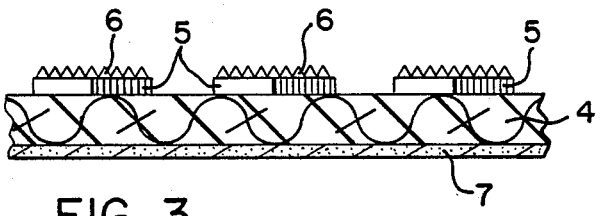

Referring to FIG. 3, reference numeral 4 depicts the rubber-impregnated cloth, 5 identifies the spaced, hexagonally shaped blanks of abrasive foil adhered to said cloth, and 6 depicts the diamond, abrasive particles covering the exposed face of said foil. The polyurethane adhesive on the reverse of the rubber-impregnated cloth is represented by 7.

Next, the composite of FIG. 2 was laminated to the composite of FIG. 3 by the conventional application of heat and pressure whereby the polyurethane adhesive 7, tightly bonded the bottom film 1 of FIG. 2 to the bottom surface of the rubber-impregnated cloth 4, to thereby form the final laminate of FIG. 1, designated generally by 8.

Using conventional means, the composite laminate 8 of FIG. 1 was then blanked into grinding or polishing pads of a suitable configuration, such as disclosed in U.S. Pat. No. 3,959,935. The pads were now ready for mounting on a polyester sheet coated lap having a root mean square roughness of 0.1 microns or less by simply peeling the release film 3 away from the tacky, PVC elastomeric layer 2, followed by positioning the pad on the lap. The polyester sheet had a surface energy of in the range of 48–52 dynes/cm, while the adhesive had a surface energy of in the range of 20–26 dynes/cm.

Grinding or polishing pads thus formed exhibited extremely high shear strength, were readily peelable from the lap for repositioning, and had just sufficient tack to quickly adhere them to the lap under only moderate hand pressure of a lb./in.$^2$ or less.

Specifically, polishing or grinding pads produced from the sheet of this Example 1 demonstrated a peel strength of 10–15 grams force/inch width; a shear strength of 1.4 to 1.75 kg. of force/cm$^2$, and a tack of approximately 30 cm travel.

EXAMPLE 2

By way of simply illustrating the interdependency of the critical physical characteristics of this invention, the following composite laminate 8 was formed, using the same components as used in Example 1, except that the weight ratio of copolymer to plasticizer was 4:3. This composition was processed into a thin film in the same manner as that of Example 1. Sheets of this cured PVC composition demonstrated peel strengths of 15–25 grams force/inch of width, shear strengths of 1.4 to 2.47 kg/cm$^2$, but tack of more than 40 cm travel; that is, not enough tack to stop the rolling ball on the maximum length of the test specimen. This film could be made to adhere to a Mylar coated substrate only by means of repeated pressing with rollers. Such low levels of tack are unsuitable for this invention even though the peel and shear strengths are acceptable.

EXAMPLE 3

A latex acrylic compound, Hycar 2600X 207 from B.F. Goodrich, was modified by the addition of a 2% solution by weight of hydroxyethyl cellulose (HEC), Cellosize QP-4400, from Union Carbide. A weight ratio of latex to solution was chosen to allow the addition of 4 parts by weight dry HEC per 100 parts by weight dry acrylic polymer.

Films of unmodified Hycar 2600x207 demonstrate peel strengths of 500–600 grams force/inch of width, shear strengths of 0.7 to 1.4 kg/cm$^2$, tack values of 2–4 cm travel, and surface tensions in the range of 47–49 dynes/cm, and thus are outside the desirable ranges. As in known to those skilled in the art, when water-soluble thickening polymers such as hydroxyethyl cellulose (HEC) or hydroxypropyl cellulose (HPC) are added to acrylic latex pressure-sensitive adhesives, the final dry polymer films show reduced tack and peel strength.

By varying the amount of HEC or HPC added to the latex, a skilled formulator can vary the tack of films produced from the latex from nil up the maximum obtainable from the latex. However, in this particular application, a practical upper limit on the amount of HEC or HPC which can be added is set by the increased sensitivity to water which these additives impart to the final dry film. It has been found that no more than 4 parts by weight dry Cellosize QP-4400 per 100 parts by weight dry Hycar 2600X 207 can be used without seriously degrading the water resistance of the adhesive film.

The latex compound described above was prepared by stirring together the calculated amount of latex and HEC solution, and allowing the mixture to stand undisturbed for 1 hour. The aged compound was then cast as a film, approximately 15 mils thick, onto a support film such as polyester, cellophane, or aluminum foil, and was dried for 15 minutes at room temperature, and 30 minutes at 60° C. (140° F.), as in Example 1. A release film as previously described was applied to the exposed surface of the adhesive film. The support film was then used as previously described as a member in the laminate 8, from which pads could be cut.

Test specimens prepared from this latex compound demonstrated peel strengths of 210–250 grams force/inch of width, shear strengths of 1.62 to 1.76 kg/cm$^2$, tack of 27–28 cm travel, and a surface tension of well within the preferred range described above.

EXAMPLE 4

The same components as described in Example 3 were used, except that the weight ratio of hydroxyethyl cellulose to latex was reduced to 1 part by weight dry HEC per 100 parts by weight dry acrylic polymer. This latex yields dry films which are much less sensitive to water than those prepared as in Example 3. However, these films demonstrate peel strengths of 480–510 grams force/inch of width and tack of 10–12 cm and therefore are unsuitable for the practice of this invention because of their excessive peel strengths.

EXAMPLE 5

An elastomeric composition was prepared using the following formulation:

| | Parts by Weight |
|---|---|
| Part A | |
| dimeric diphenylmethane diisocyanate | 22.2 |
| Part B | |
| polyoxypropylene glycol | 74.4 |
| 1,4-butanediol | 3.4 |
| dibutyltin dilaurate | 0.01% by weight of the glycol |

This polyurethane elastomeric composition was prepared by rapidly mixing Parts A and B, and casting the mixture immediately as a film as in Example 1. This mixture gels quickly once mixed (approximately 6–10 minutes) and cannot be stored. When the film is allowed to cure at room temperature for 7 days, it presents a surface which is very slightly tacky to touch, but which blocks tenaciously to itself. If film surfaces remain in contact longer than 12 hours, they cannot be separated without tearing the support films. The film blocks to polyester film with initial peel strengths of 250–290 grams force/inch of width, and when allowed to age, the bonds become much stronger, up to 500 grams force/inch of width. Such peel strengths are too high for the practice of this invention.

When the film is cured more vigorously (room temperature for 16 hours and then at 100° C. (212° F.) for 1 hour), the surface tack disappears. Films will block to themselves but can be separated without damage as long as 2 years later. Peel strengths are relatively constant with age at 200–230 grams force/inch of width. Lap shear strengths are very high, about 50 lbs./in.$^2$, but tack is at the low end at about 30 cm travel.

Obviously, extent of cure is a variable in this system, and as such can be varied to produce a combination falling within the acceptable peel, shear and tack limits for this invention.

We claim:

1. In the combination of a tool having a relatively rigid, unyielding base substrate having a work surface of predetermined non-planar contour and configuration, and a grinding or polishing member adhesively mounted on and conforming to said tool work surface, the improvement comprising an essentially non-strippable, unreactive, smooth, glossy film affixed to and conforming to said work surface, beneath said member and exhibiting virtually no surface adhesive characteristics, and having a root mean square roughness of less than or equal to 0.1 micron, and a layer of adhesive releasably joining together said film and said grinding or polishing member, said adhesive layer having a shear value with respect to said film of at least 0.7 kg./cm$^2$, a peel strength from about 10 to about 250 grams force per inch width, a tack value of about 15 to 30 cm travel, and a surface tension less than, or equal to, the surface energy of said film.

2. The combination as defined in claim 1, wherein said film is sheet polymer.

3. The combination as defined in claim 2, wherein said sheet polymer is a polyester.

4. The combination as defined in claim 1, wherein the surface tension of said adhesive layer is in the range of about 45 to 100 dynes/cm, and the surface energy of said film is in the range of about 40 to 200 dynes/cm.

5. The combination as defined in claim 1, wherein said grinding or polishing member comprises a flexible substrate having abrasive particles projecting from one surface thereof, and having said adhesive layer secured to and covering the opposite surface thereof, said adhesive layer presenting at the side thereof remote from said substrate a pressure-sensitive, tacky surface having a surface tension in the range of 45 to 100 dynes/cm.

6. The combination as defined in claim 5 wherein said adhesive layer comprises a liquid plasticizer and a polymer selected from the group consisting of granular polyvinyl chloride, or polyvinyl chloride-ethylene copolymer, an acrylic latex compound modified by hydroxyethyl cellulose, and a polyurethane elastomer.

7. An abrasive lens grinding or polishing pad, comprising a flexible substrate having abrasive particles projecting from one surface thereof, a flexible base layer secured by a first layer of adhesive to the opposite side of said substrate, and a second, elastomeric layer of adhesive secured at one side to and covering said base layer, and having at its opposite side a tacky surface for releasably securing the pad to the smooth surface of a lapping tool, or the like, said second layer of adhesive comprising a liquid plasticizer and a polymer selected from the group consisting of granular polyvinyl chloride, or polyvinyl chloride-ethylene copolymer an acrylic latex compound modified by hydroxyethyl cellulose, and a polyurethane elastomer, and said tacky surface having a surface tension in the range of 45 to 100 dynes/cm, and a peel strength of about 250 grams force per/inch width, and tack value of about 15 to 30 cm. travel.

8. The combination of a lapping tool having a work surface, and an abrasive lens grinding or polishing pad of the type defined in claim 7 releasably adhered by the tacky surface thereof to said tool work surface, wherein said tool work surface has a root mean square roughness of less than or equal to 0.1 micron, and said second adhesive layer has a shear value with respect to said work surface of at least 0.7 kg./cm$^2$.

9. The combination as defined in claim 8, wherein said work surface has a surface energy in the range of about 40 to 200 dynes/cm.

* * * * *